US012753565B2

(12) United States Patent
Fraser

(10) Patent No.: US 12,753,565 B2
(45) Date of Patent: Oct. 6, 2026

(54) MODULAR WALL SYSTEM

(71) Applicant: Mark Andrew Fraser, Hamilton (AU)

(72) Inventor: Mark Andrew Fraser, Hamilton (AU)

(73) Assignee: Mark Andrew Fraser, Hamilton (AU)

( * ) Notice: Subject to any disclaimer, the term of this patent is extended or adjusted under 35 U.S.C. 154(b) by 74 days.

(21) Appl. No.: 18/569,075

(22) PCT Filed: Jun. 9, 2022

(86) PCT No.: PCT/AU2022/050570

§ 371 (c)(1),
(2) Date: Dec. 11, 2023

(87) PCT Pub. No.: WO2022/256873

PCT Pub. Date: Dec. 15, 2022

(65) Prior Publication Data

US 2024/0279896 A1 Aug. 22, 2024

(30) Foreign Application Priority Data

Jun. 11, 2021 (AU) ..... 2021203907

(51) Int. Cl.
*E02D 29/02* (2006.01)

(52) U.S. Cl.
CPC ..... *E02D 29/025* (2013.01); *E02D 2600/20* (2013.01)

(58) Field of Classification Search
CPC ... E02D 29/025; E02D 2600/20; E02D 29/02; E04B 2/8617
See application file for complete search history.

(56) References Cited

U.S. PATENT DOCUMENTS

| | | | | |
|---|---|---|---|---|
| 4,730,422 | A | 3/1988 | Young | |
| 4,742,659 | A | 5/1988 | Meilleur | |
| 4,884,382 | A | 12/1989 | Horobin | |
| 5,625,989 | A | 5/1997 | Brubaker et al. | |
| 6,178,711 | B1 | 1/2001 | Laird et al. | |
| 6,240,692 | B1 | 6/2001 | Yost et al. | |
| 6,401,419 | B1 | 6/2002 | Beliveau | |
| 7,866,097 | B1 * | 1/2011 | Moyher | E02D 27/02 52/302.4 |
| 7,882,672 | B2 | 2/2011 | Emblin | |
| 10,233,634 | B1 | 3/2019 | Venturo | |
| 2004/0045238 | A1 | 3/2004 | Dunn et al. | |
| 2005/0028466 | A1 | 2/2005 | Titishov | |

(Continued)

FOREIGN PATENT DOCUMENTS

| | | |
|---|---|---|
| AU | 2508877 | 11/1978 |
| GB | 2458317 | 9/2009 |

(Continued)

OTHER PUBLICATIONS

Innovation Examination Report—4117825-0001 (28166438).
International Search Report PCT/AU2022/050570.

*Primary Examiner* — Carib A Oquendo
(74) *Attorney, Agent, or Firm* — DeLio Peterson & Curcio LLC; David R. Pegnataro

(57) ABSTRACT

The present invention relates to a modular wall system including wall modules for forming a pair of walls; and spacers for spacing the walls apart. Advantageously, the system may be provided in kit form as a do-it-yourself system.

19 Claims, 4 Drawing Sheets

(56) References Cited

U.S. PATENT DOCUMENTS

| | | | | |
|---|---|---|---|---|
| 2009/0308011 | A1* | 12/2009 | Philippe | E04B 2/8635 249/190 |
| 2013/0081353 | A1* | 4/2013 | Jensen | E04B 2/40 52/742.1 |
| 2014/0259990 | A1 | 9/2014 | Pfeiffer | |
| 2015/0308113 | A1* | 10/2015 | Blum | E04C 1/40 52/404.4 |
| 2017/0191266 | A1* | 7/2017 | Androsiuk | E04C 2/296 |
| 2019/0330843 | A1* | 10/2019 | Morokutti | F16B 5/0052 |

FOREIGN PATENT DOCUMENTS

| | | | |
|---|---|---|---|
| KR | 101776783 | B1 | 9/2017 |
| WO | 9901626 | A1 | 1/1999 |
| WO | 2007082378 | A1 | 7/2007 |
| WO | 2012070079 | A2 | 5/2012 |
| WO | 2015107355 | A2 | 7/2015 |

* cited by examiner

MODULAR WALL SYSTEM

BACKGROUND OF THE INVENTION

1. Field of the Invention

The present invention relates to a modular wall system. The present invention has particular, although not exclusive, application to a modular gardening retaining wall system.

2. Description of Related Art

The reference to any prior art in this specification is not, and should not be taken as, an acknowledgement or any form of suggestion that the prior art forms part of the common general knowledge.

Retaining walls are used in gardens to retain earthworks and form garden beds.

In practice, skilled landscape gardeners are engaged to build retaining walls which can be quite expensive. In some cases, retaining walls are required although not built, owing to the expense.

The embodiments of the present invention provide a more cost effective means for building retaining walls, without the need to engage a landscaper.

SUMMARY OF THE INVENTION

According to one aspect of the present invention, there is provided a modular wall system including:

wall modules for forming a pair of walls; and spacers for spacing the walls apart.

Advantageously, the system may be provided in kit form as a do-it-yourself system.

The wall modules may include module interlocking means to interlock adjacent wall modules together. The interlocking means may include one or more tongues for being received in one or more grooves. The tongues may fit vertically or axially in respective grooves. The fit may be snug. An end tongue of one of the wall modules may be received in an end groove of another one of the wall modules so that the wall modules may be oriented so as to be misaligned.

The system may include spacer interlocking means for interlocking the wall modules with the spacers. The spacer interlocking means may include a tongue and groove arrangement. The tongue and groove arrangement may include tongues for sliding vertically or transversely into respective grooves.

The wall modules and spacers may be located in rows. The spacers may include first and second spacers. The first spacers may be vertically oriented, whereas the second spacers may be horizontally oriented. Each first spacer may include a panel, and a pair of tongues terminating either side of the panel. The panel may include an aperture through which rebar may pass. Each second spacer may include a panel, and tongues on either side of the panel. Each second spacer may include spacer interlocking means for interlocking adjacent spacers. The spacer interlocking means may include a tongue and groove arrangement.

The system may further include capping for capping the walls. The system may include capping interlocking means for interlocking the capping with the walls. The capping interlocking means may include a tongue and groove arrangement. The tongue and groove arrangement may include tongues for sliding axially into respective grooves.

The system may further include cladding for cladding the walls. The system may include cladding interlocking means for interlocking the cladding with the walls. The cladding interlocking means may include a tongue and groove arrangement. The tongue and groove arrangement may include tongues for sliding transversely or vertically into respective grooves. The cladding may include end cladding, side cladding and/or top cladding.

The system may further include concrete or foam or other fillers between the walls to provide support or noise reduction. The wall modules, spacers, capping and/or cladding may be integrally formed, and in at least one embodiment, are injection molded from polymeric material. Each wall module may be straight or curved.

The system may be a retaining wall or building construction system.

According to another aspect of the present invention, there is provided a method for assembling a modular wall system including:

spacing a pair of wall modules apart using a spacer.

Any of the features described herein can be combined in any combination with any one or more of the other features described herein within the scope of the invention.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF THE EMBODIMENTS

Figure 1:
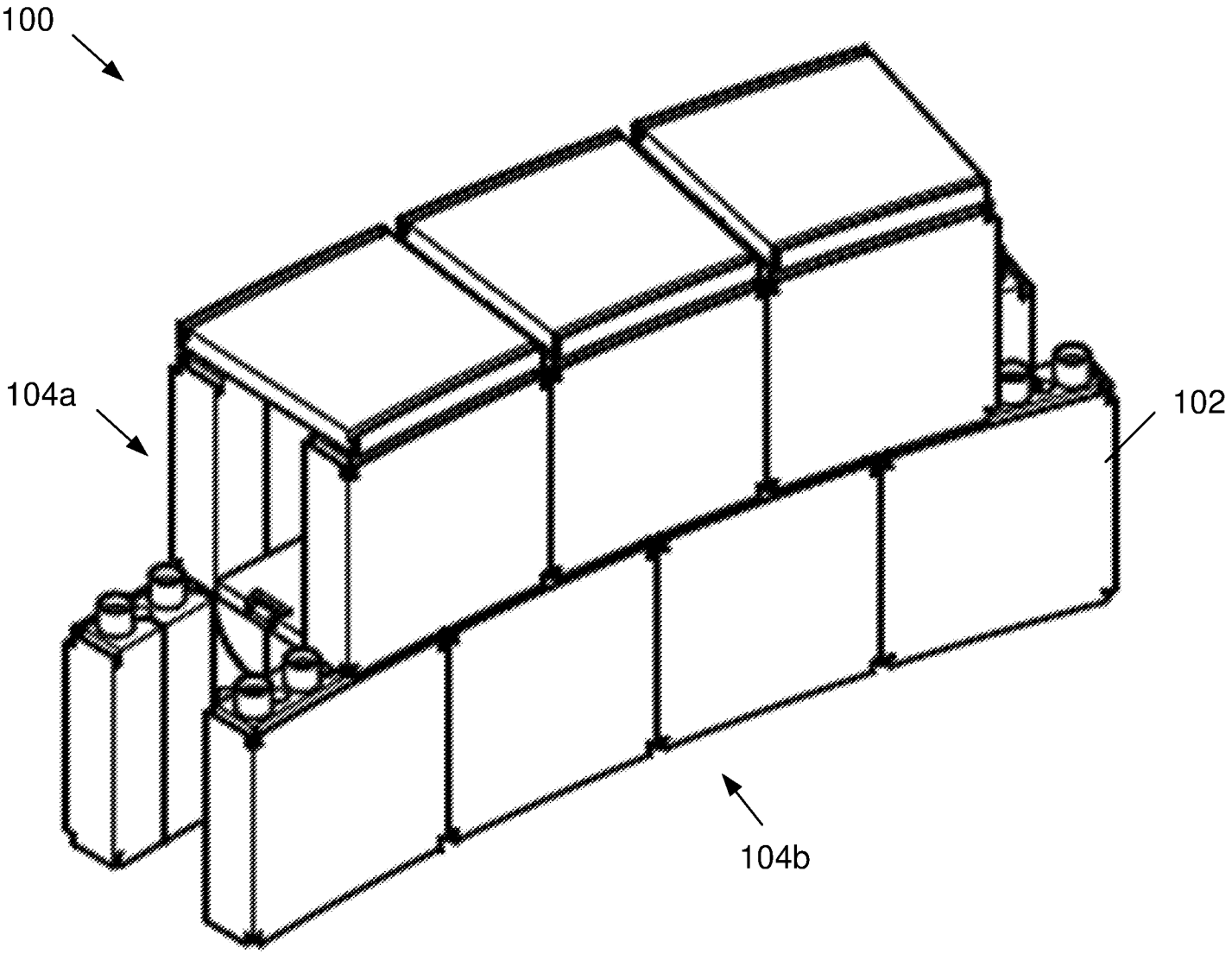
FIG. 1 is a perspective view of a modular gardening retaining wall system in accordance with an embodiment of the present invention.

In describing the embodiments of the present invention, reference will be made herein to FIGS. 1-7 of the drawings, in which like numerals refer to like features of the invention.

Certain terminology may be used herein for convenience only and is not to be taken as a limitation of the invention. For example, words such as "upper," "lower," "left," "right," "horizontal," "vertical," "upward," "downward," "clockwise," "counterclockwise," "longitudinal," "lateral," or "radial" merely describe the configuration shown in the drawings. Indeed, the referenced components may be oriented in any direction and the terminology, therefore, should be understood as encompassing such variations unless specified otherwise. For purposes of clarity, the same reference numbers may be used in the drawings to identify similar elements.

Additionally, in the subject description, the words "exemplary," "illustrative," or the like may be used to mean serving as an example, instance, or illustration. Any aspect or design described herein as "exemplary" or "illustrative" is not necessarily intended to be construed as preferred or advantageous over other aspects or design. Rather, the use of the words "exemplary" or "illustrative" is merely intended to present concepts in a concrete fashion.

According to an embodiment of the present invention, there is provided a modular wall system 100 as shown in FIG. 1. The system 100 includes many modules including block wall modules 102 for forming a pair of walls 104*a*, 104*b*, and horizontal and vertical spacers for spacing the walls 104*a*, 104*b* apart as explained in detail below.

Advantageously, the system 100 may be provided in kit form as a do-it-yourself system 100 so that users without landscaping skills can readily assemble the system 100. The system 100 may further include concrete, foam or other fillers poured between the walls 104*a*, 104*b* as they are sequentially built.

Figure 2:
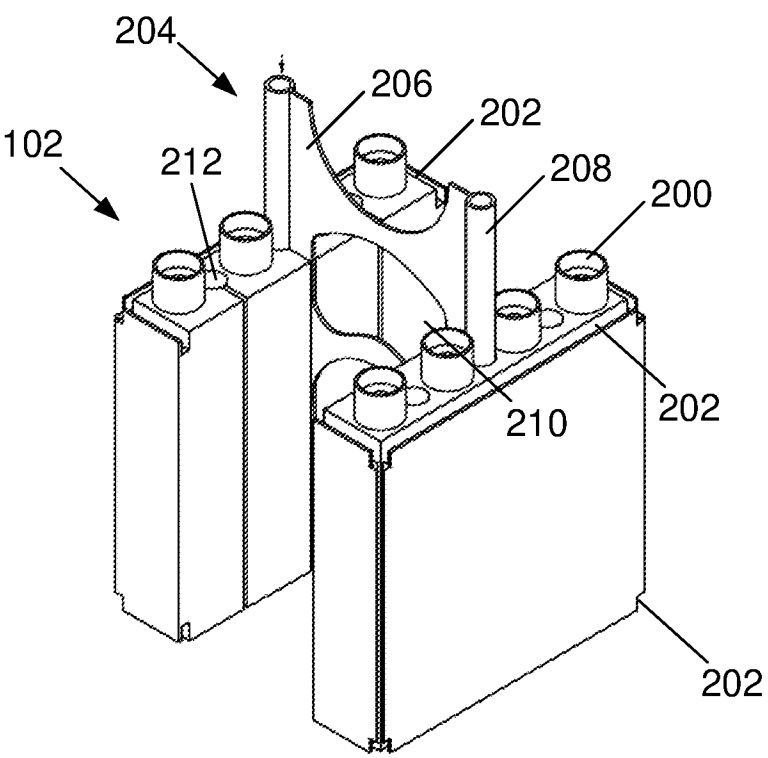
FIG. 2 is a perspective view of wall modules and an interlocking vertical spacer of the system of FIG. 1.

Turning to FIG. 2, the wall modules 102 may include module interlocking means to vertically interlock adjacent wall modules 102 together. In particular, the interlocking means may include top tongues 200 for being received in respective underside grooves (not shown). In at least one embodiment, the tongues 200 snugly fit vertically and axially in respective underside grooves. The perimeter of the wall modules 102 defines elongate cladding grooves 202 for receiving tongues of cladding parts as explained below.

The system 100 may further include vertical (i.e. first) spacers 204. Spacer interlocking means may be provided for interlocking the wall modules 102 with the spacers 204. In an embodiment, the spacer interlocking means includes a tongue and groove arrangement. Each spacer 204 may include a panel 206, and a pair of bulbous tongues 208 terminating either side of the panel 206. The panel 206 may include an aperture 210 through which rebar reinforcement may pass. In an embodiment, the bulbous tongues 208 of the tongue and groove arrangement slide vertically and transversely into respective complementary grooves 212 in the modules 102.

Figure 3:
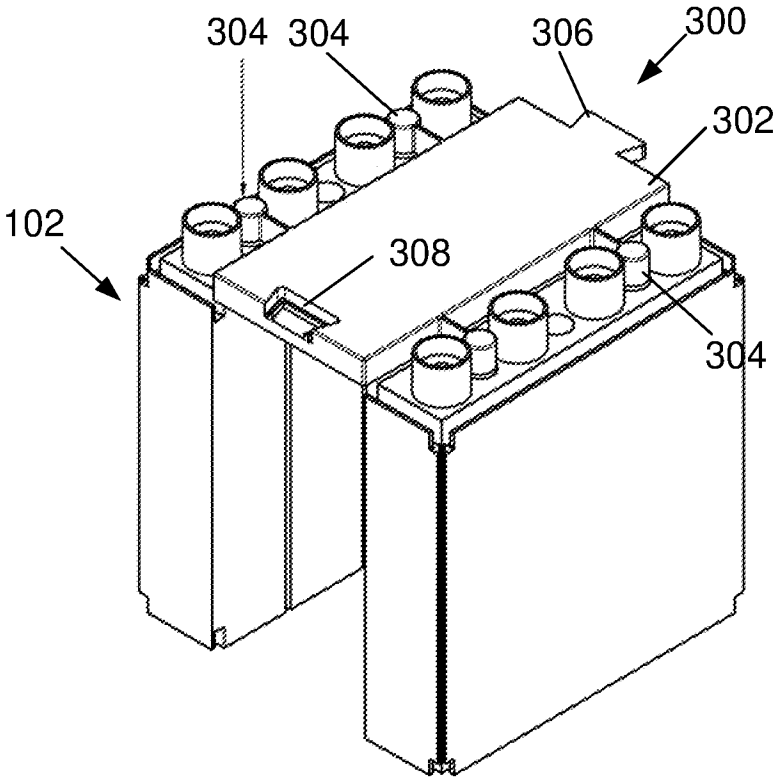
FIG. 3 is a perspective view of wall modules and an interlocking horizontal spacer of the system of FIG. 1.

Turning to FIG. 3, the system 100 also may include horizontal (i.e. second) spacers 300 that rest on the vertical spacers 204. Each horizontal spacer 300 may include a panel 302, and tongues 304 on either side of the panel 302. The tongues 304 may have a bulbous head terminating in a neck. In one or more embodiments, the bulbous tongues 304 of the tongue and groove arrangement slide vertically and transversely into respective complementary grooves 212 in the modules 102, as before.

Each horizontal spacer 300 may also include another spacer interlocking means for interlocking like adjacent spacers 300. In an embodiment, this spacer interlocking means includes a dove-tail tongue and groove arrangement, with tongue 306 and opposing complementary groove 308.

Figure 4:
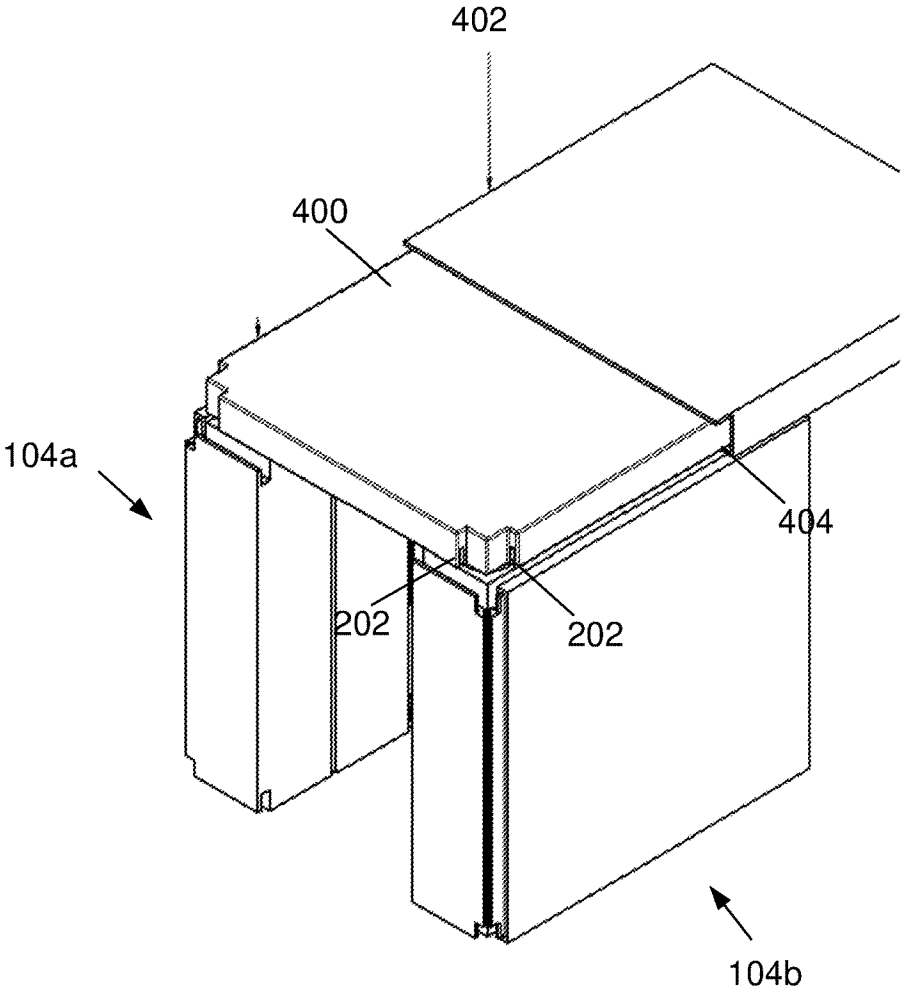
FIG. 4 is a perspective view of wall modules, top capping and top cladding of the system of FIG. 1.

Turning to FIG. 4, the system 100 may further include capping 400 for capping the uppermost modules 102 of the walls 104, once all the modules 102 are laid. Similar to before, the system 100 may include capping interlocking means for interlocking the capping 400 with the walls 104. In one or more embodiments, the capping interlocking means includes a tongue and groove arrangement. In particular, the tongue and groove arrangement may include module tongues 200 for sliding axially into respective grooves (not shown) on the underside of the capping 400.

Figure 5:
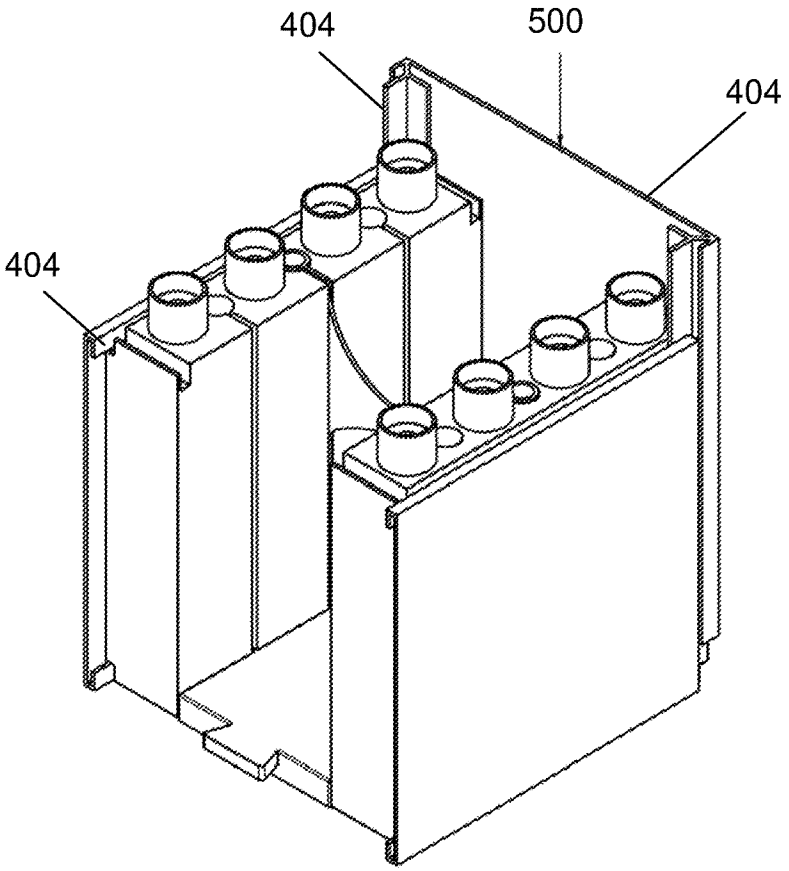
FIG. 5 is a perspective view of wall modules and end cladding of the system of FIG. 1.
Figure 6:
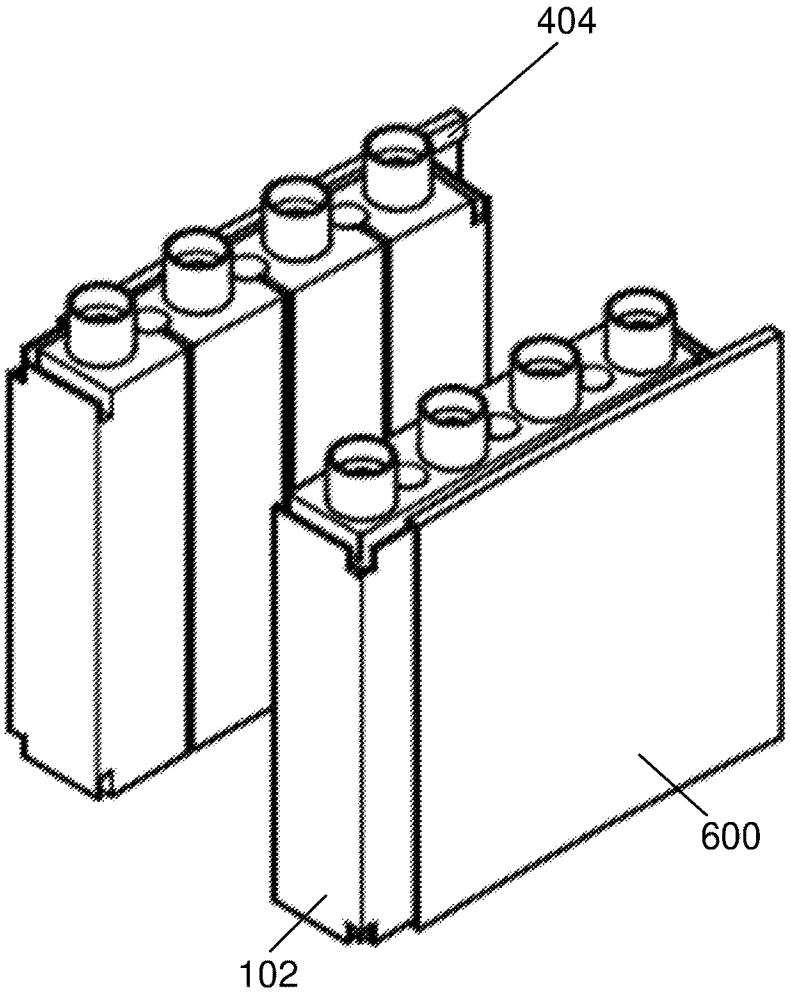
FIG. 6 is a perspective view of wall modules and interlocking side cladding of the system of FIG. 1.

In an embodiment, the perimeter of the capping 400 defines elongate cladding grooves 202 for receiving tongues of cladding for cladding the walls 104, as before. In at least one embodiment, the cladding includes top cladding 402 as shown in FIG. 4, end cladding 500 as shown in FIG. 5, and side cladding 600 as shown in FIG. 6.

The system 100 may further include cladding interlocking means for interlocking the cladding with the walls. In an embodiment, the cladding interlocking means includes a tongue and groove arrangement. The tongue and groove arrangement may include cladding tongues 404 for being received in respective cladding grooves 202.

The wall modules 102, spacers 204, 300, capping 400 and cladding 402, 500, 600 may be integrally formed, resilient and in at least one embodiment are injection molded from polymeric material. The wall modules 102 may be straight, or curved to form corners or curved walls.

Figure 7:
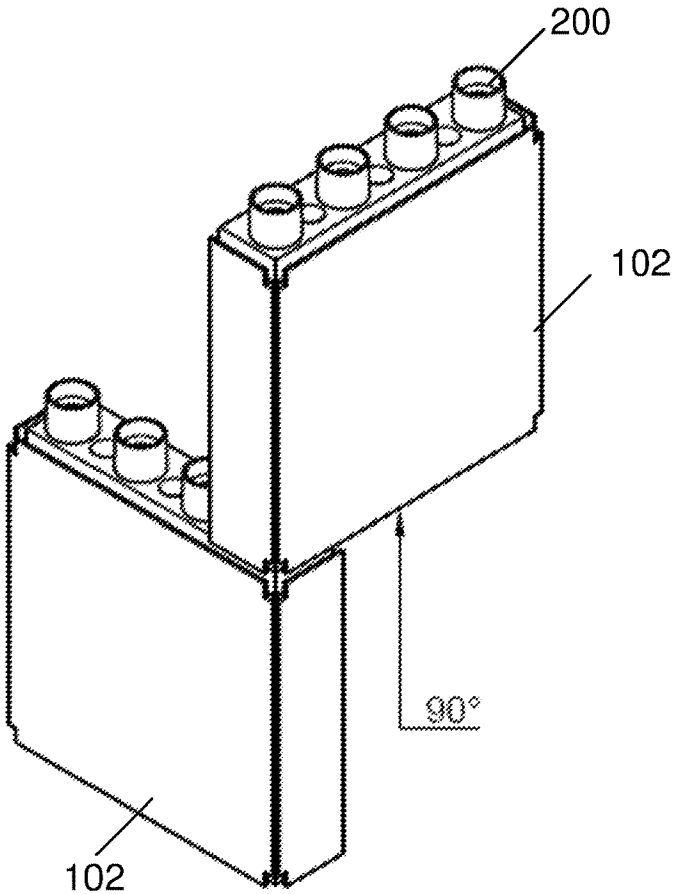
FIG. 7 is a perspective view showing pivoting of the wall modules of the system of FIG. 1.

As shown in FIG. 7, an end tongue 200 of one of the wall modules 102 can be received in an end groove of another one of the wall modules 102 so that the wall modules 102 can be oriented so as to be misaligned in forming corners or angled walls.

An exemplary method for assembling the modular wall system 100 is now described.

Initially, the method involves spacing a pair of wall modules 102 apart using an interconnected vertical spacer 204 (FIG. 2). A base row of the walls 104*a*, 104*b* is then similarly formed (FIG. 1). Concrete can be poured between the modules 102.

Next, the horizontal spacers 300 are interconnected with the wall modules 102, rested on the vertical spacers 204 and interconnected together to form a shelf extending along the base row of the walls 104*a*, 104*b* (FIG. 3).

Next, the side cladding 600 is interlocked with the wall modules 102 (FIG. 6), and the end cladding 500 received by the end of the base row of the walls 104*a*, 104*b* (FIG. 5).

Next, additional rows of the walls 104*a*, 104*b* are formed to a desired height (FIG. 1) in the same manner.

Next, the capping 400 is interlocked with the top row of the walls 104*a*, 104*b* (FIG. 4).

Finally, the top cladding 402 is interlocked with the capping 400, or in some embodiments with the wall modules 102 directly.

A person skilled in the art will appreciate that many embodiments and variations can be made without departing from the ambit of the present invention.

The system 100 of the preferred embodiment may be used to form a retaining wall. In other embodiments, the system 100 may be used in building construction.

In one embodiment, the vertical spacers 204 have a solid panel 206, with no aperture 210, to "close off" vertical sections of the wall system 100. These sections can then be filled with concrete (or other fillers) to create structural columns to create or allow for post and beam construction, as opposed to solid reinforced wall construction.

The present invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

Thus, having described the invention, what is claimed is:

1. A modular wall system including:

wall modules for forming a pair of walls; and spacers for spacing the walls apart, the spacers including first spacers being vertically oriented, the first spacers being separate components positioned between the wall modules; and a spacer interlocking arrangement for interlocking the wall modules with the first spacers, wherein the spacer interlocking arrangement includes one or more tongues provided on one of the spacers or the wall modules and corresponding grooves provided on the other of the spacers or the wall modules, the tongues and grooves receivable with one another to permit sliding engagement between the first spacers and the wall modules, wherein the wall modules and spacers are located in rows, the spacers including second spacers being horizontally oriented and spanning the wall modules to form a shelf.

2. A modular wall system as claimed in claim 1, wherein the wall modules include a module interlocking arrangement to interlock adjacent wall modules together, the module interlocking arrangement including tongues on each wall module for being received in one or more grooves.

3. A modular wall system as claimed in claim 2, wherein the tongues fit vertically or axially in respective grooves, the fit being snug.

4. A modular wall system as claimed in claim 2, wherein an end tongue of one of the wall modules is received in an end groove of another one of the wall modules so that the wall modules can be oriented so as to be misaligned.

5. A modular wall system as claimed in claim 1, wherein the tongues are provided on the spacers and the grooves are provided on the wall modules.

6. A modular wall system as claimed in claim 5, wherein the tongues are positioned for sliding vertically or transversely into respective grooves.

7. A modular wall system as claimed in claim 1, wherein each spacer includes a panel, and the spacer interlocking arrangement includes a pair of tongues terminating either side of the panel.

8. A modular wall system as claimed in claim 1, wherein at least one first spacer includes an aperture through which reinforcement can pass.

9. A modular wall system as claimed in claim 1, wherein each second spacer includes a spacer interlocking arrangement for interlocking adjacent second spacers, the spacer interlocking arrangement including a tongue and groove arrangement.

10. A modular wall system as claimed in claim 1, further including capping for capping the walls.

11. A modular wall system as claimed in claim 10, further including a capping interlocking arrangement for interlocking the capping with the walls, the capping interlocking arrangement including a tongue and groove arrangement with tongues for sliding axially into respective grooves.

12. A modular wall system as claimed in claim 1, further including cladding for cladding the walls by way of sliding engagement.

13. A modular wall system as claimed in claim 12, including a cladding interlocking arrangement for interlocking the cladding with the walls, the cladding interlocking arrangement including a tongue and groove arrangement.

14. A modular wall system as claimed in claim 12, wherein the cladding includes end cladding, side cladding and top cladding.

15. A modular wall system as claimed in claim 1, wherein the system further includes concrete, foam, or other fillers between the walls, sequentially formed in layers between shelves.

16. A modular wall system as claimed in claim 1, wherein the wall modules and spacers are integrally formed and injection molded from polymeric material, and wherein capping and/or cladding of the system are also integrally formed and injection molded from polymeric material.

17. A modular wall system as claimed in claim 1, further including another spacer interlocking arrangement for interlocking the wall modules with the second spacers.

18. A method for assembling a modular wall system including:

spacing a pair of wall modules apart using a first spacer and a second spacer, one of the spacers or the wall modules comprising one or more tongues and the other of the spacers or the wall modules comprising corresponding grooves, the tongues and grooves receivable with one another to permit sliding engagement; and interlocking the wall modules with the first spacer being vertically oriented and the second spacer being horizontally oriented and spanning the wall modules to form a shelf.

19. The method of claim 18 further comprising:

spacing a second pair of wall modules apart using first spacers and second spacers;

interlocking the second pair of wall modules with the first spacers being vertically oriented and the second spacers being horizontally oriented and spanning the wall modules to form a second shelf, the wall modules and spacers being located in rows; and pouring concrete, foam, or other fillers between the pairs of wall modules, sequentially formed in layers between shelves.

* * * * *